United States Patent [19]

Wallin et al.

[11] Patent Number: 4,782,989

[45] Date of Patent: Nov. 8, 1988

[54] COMPENSATING NAIL-DRIVING CHUCK FOR PALLET-MAKING MACHINE

[75] Inventors: Roger N. Wallin, St. Francis, Minn.; Jack Gresham, Armuchee, Ga.

[73] Assignee: Viking Engineering & Development, Inc., Fridley, Minn.

[21] Appl. No.: 86,937

[22] Filed: Aug. 17, 1987

[51] Int. Cl.[4] ..... B27F 7/09

[52] U.S. Cl. ..... 227/149; 227/110; 227/140

[58] Field of Search ..... 227/110, 111, 120, 140, 227/149

[56] References Cited

U.S. PATENT DOCUMENTS

| | | | |
|---|---|---|---|
| 2,530,626 | 11/1950 | Paxton | 227/140 |
| 2,679,044 | 5/1954 | Bacon et al. | 227/140 |
| 3,743,158 | 7/1973 | Cohn et al. | 227/110 X |
| 3,945,549 | 3/1976 | Colson | 227/45 |
| 4,197,886 | 4/1980 | MacDonald | 227/149 X |
| 4,444,348 | 4/1984 | Campbell, Jr. | 227/149 |

*Primary Examiner*—Paul A. Bell

*Attorney, Agent, or Firm*—Kinney & Lange

[57] ABSTRACT

A compensating nail-driving chuck uniformly countersinks nails into boards, despite variations in thickness and hardness of the boards. The nail-driving chuck has a chuck body with jaws at the lower end for holding a nail. A hydraulic cylinder has a drive rod which is connected to a drive pin for driving the nail out through the jaws and into the board. The chuck body is movable with the drive rod until a surface of the board is engaged. At that point, movement of the chuck body stops, and relative movement of the drive rod and drive pin with respect to the chuck body begins. The chuck body limits the stroke of the drive rod, so that the nail is driven a uniform distance into the board once the surface of the board has been engaged.

8 Claims, 4 Drawing Sheets

44
46
48
18
46
48
46
72
64
82
52
50
54
56
58
60
62
66
70
68
74

18
14
44
52
50
54
56
58
60
62
66
68
70
72
74
76
82
20
24
28
22
46

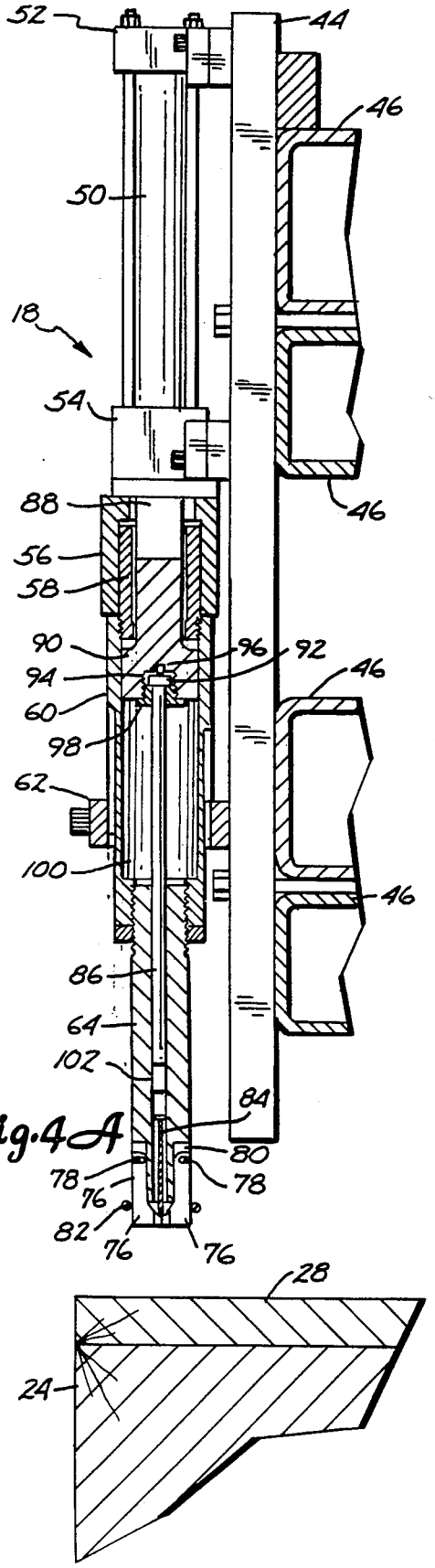
Fig. 4A
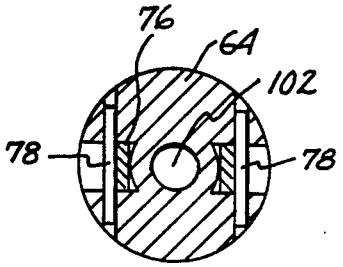
Fig. 6
Fig. 5
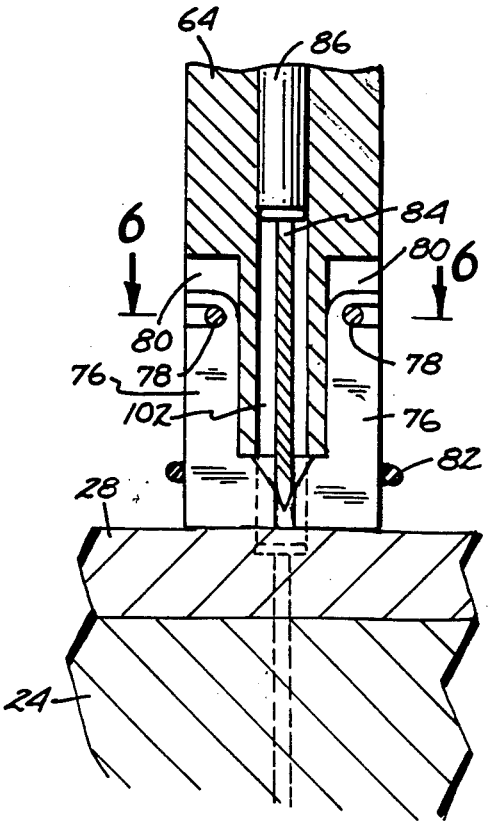

COMPENSATING NAIL-DRIVING CHUCK FOR PALLET-MAKING MACHINE

BACKGROUND OF THE INVENTION

1. Field of the Invention.

The present invention relates to pallet-making machines, and in particular to nail-driving chucks for use in a pallet-making machine.

2. Description of the Prior Art.

Wooden pallets, as they are known today, first came into widespread use during World War II as a result of the need of the United States Navy to move large amounts of goods in short periods of time with forklift trucks. The usage of wooden pallets has increased every year since that time.

In 1987, it is projected that about 380 million new wooden pallets will be built in the United States. Pallets consume about twenty percent of the lumber that is used in the United States annually. The manufacture of pallets is second only to the construction industry and is ahead of all other industries in the use of lumber. Wooden pallets consume about fifty percent of the hardwood lumber used annually in the United States.

To satisfy the high demand for wooden pallets, machines have been developed which manufacture pallets on a semi-automatic or automatic basis. An example of automated pallet-making equipment is shown in the Colson U.S. Pat. No. 3,945,549.

The Colson patent shows a type of pallet-making machine which uses a vibrating bowl to feed bulk nails to a picker mechanism, which individually feeds the nails to a chuck. Each time a nailing operation is to take place, a ram drives the nail being held by the chuck into the boards located below the chuck.

It is extremely important that the nails which are driven into the boards of a pallet be countersunk, i.e. the head of the nail must be driven into the wood so that it does not protrude above the top surface of the board. Countersinking is of critical importance because many pallets are used for the movement of bagged goods or other packaged material. If nail heads are protruding from the pallet, there is a danger that the heads will puncture the bags, which results in spilling of the contents of the bags.

Several factors complicate the ability to countersink nails on a consistent basis. First, the thicknesses of the boards being nailed can vary. Saws do not always cut the boards to a uniform thickness. Second, the condition of the wood can vary substantially. During the summer, when the boards are warm, it is much easier to drive nails into the wood than it is in the winter, when the boards may be very cold or even frozen.

SUMMARY OF THE INVENTION

The present invention is a compensating nail-driving chuck which uniformly drives and countersinks nails into boards despite variations in board thickness and in the hardness of the wood. The nail-driving chuck of the present invention includes a chuck body which is movable along a path which is generally perpendicular to a surface of a board to be nailed. The chuck body includes jaw means positioned at an end closest to the board for holding a nail.

When a nail is to be driven, drive means move a drive member along the path in a first direction. The chuck body is movable with the drive member in the first direction toward the board until a surface of the board is engaged. Nail driving means connected to the drive member moves relative to the chuck body after the surface of the board is engaged to drive the nail out through the jaw means and into the board.

By first engaging the board and then driving the nail, the nail-driving chuck of the present invention compensates for variations in board thickness and hardness of the wood. In preferred embodiments, the chuck includes means for limiting movement of the nail-driving means in the first direction toward the board. This causes the heads of nails to be countersunk a predetermined uniform depth with respect to the surface of the board.

BRIEF DESCRIPTION OF THE DRAWINGS

FIGS. 4A–4C are sectional views of the nail-driving chuck at three different operation positions during a cylce of operation.

FIG. 5 is a sectional view showing the jaws of the chuck in further detail.

FIG. 6 is a sectional view along Section 6—6 of FIG. 5.

DETAILED DESCRIPTION OF THE PREFERRED EMBODIMENTS

Figure 1:
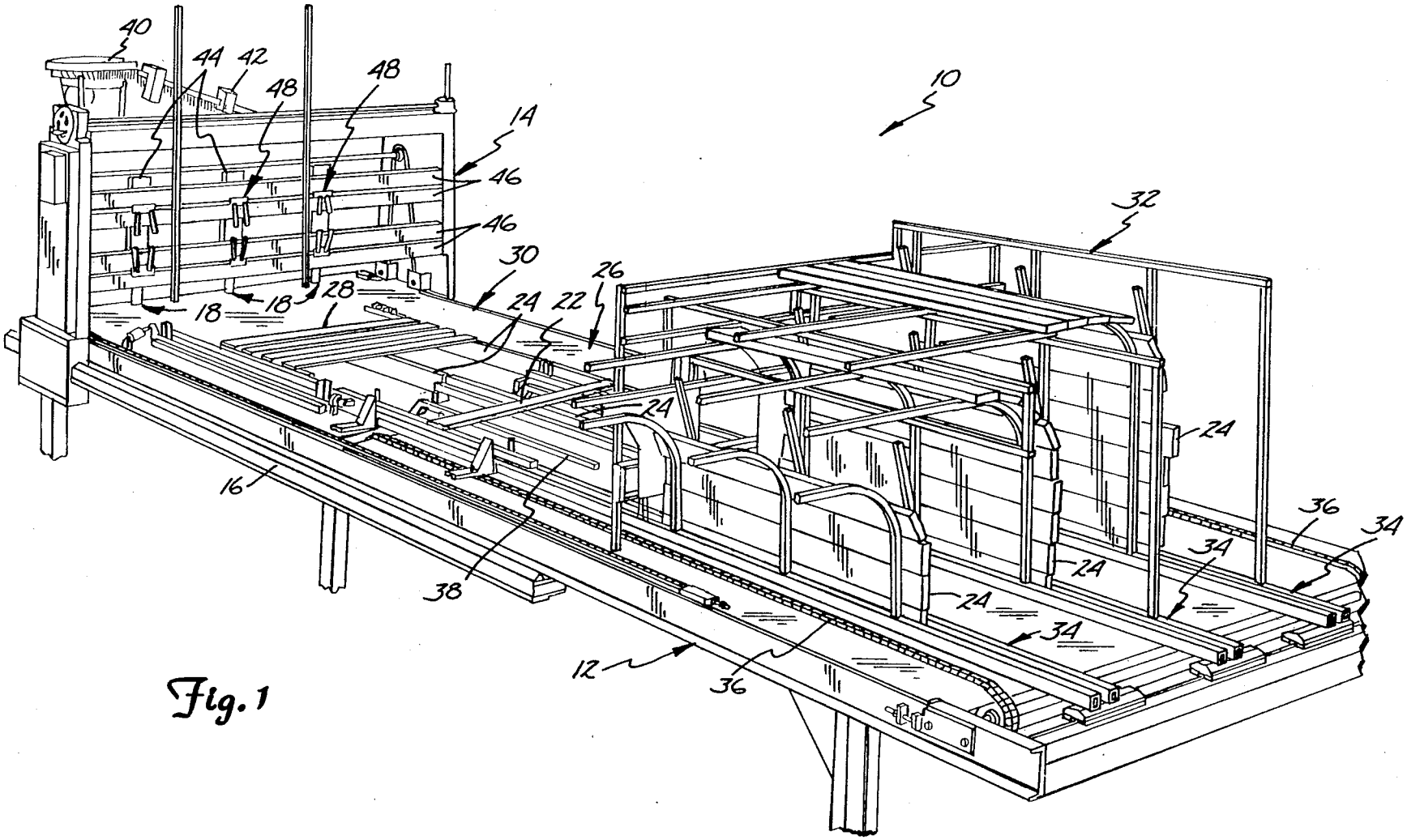
FIG. 1 is a perspective view of a pallet-making machine.

A pallet-making machine 10 shown in FIG. 1 is an automated machine which can be operated by a single person, and which is capable of producing pallets at a rate of approximately one finished pallet per minute. Machine 10 has a bed or frame 12 which is stationary and a traveling bridge 14 which moves longitudinally on rails 16, which are attached to frame 12. Travelling bridge 14 carries nail-driving chucks 18 which drive the nails which hold together the assembled pallets. The actuation of nail-driving chucks 18 is controlled by a microcomputer control system located within a control panel (not shown) based upon singles from board sensors 20 (FIG. 2) which are carried by traveling bridge 14.

During each operating cycle, two pallets normally are being assembled. A first pallet is having bottom deck boards 22 attached to stringers 24 at first station 26, while a second pallet is having top deck boards 28 attached to stringers 24 at second station 30. Stringers 24 are fed out of delivery racks 32 along tracks 34 to first station 26. The advancing of stringers 24 is provided by a chain drive 36 with stringer-pushing dogs (not shown).

When stringers 24 are in position at first station 26, chain drive 36 stops and the operator then places top deck boards 28 across stringers 24 at second station 30 and then places bottom deck boards 22 across stringers 24 at first station 26. Travelling bridge 14 then is advanced along rails 16 toward racks 32. As bridge 14 travels over top deck boards 28 at second station 30, nail-driving chucks 18 are actuated to drive nails into top deck boards 28 to fasten top deck boards 28 and stringers 24 together. Similarly, as traveling bridge 14 moves over bottom deck boards 22 at first station 26, chucks 18 are actuated to drive nails into bottom boards 22.

When traveling bridge 14 reaches the end of its travel, it reverses direction and returns to its home position which is shown in FIG. 1. The completed pallet is driven from second station 30 to a stacking station (not shown) located behind the home position of bridge 14. The semi-finished pallet with the bottom deck boards 22 attached is flipped over by flippers 38 and positioned at second station 30. In the meantime, a new set of stringers 24 are advanced from racks 32 to first station 26 by chain drive 36.

During each operating cycle, therefore, a first pallet is being partially completed at first station 26, a second pallet is being completed at second station 30, and a third pallet is being stacked at the stacking station (not shown). The operator need only provide the deck boards at stations 26 and 30, and machine 10 forms all of the nailing operations, as well as the advancing of stringers 22, flipping of the semi-finished pallet, and stacking of the finished pallets.

In the embodiment of pallet-making machine 10 shown in FIG. 1, nails are provided to the nail-driving chucks 18 one at a time from a bulk nail supply system. Buck nails are fed from a common feedbowl 40 through a multichannel pick mechanism 42 to the individual chucks 18. Feedbowl 40 and pick mechanism 42 are carried on traveling bridge 14.

Figure 3:
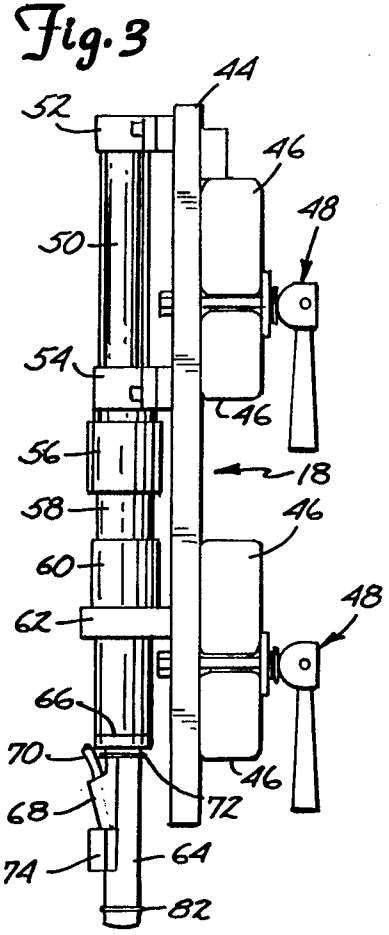
FIG. 3 is a side view of one of the nail-driving chucks.
Figure 2:
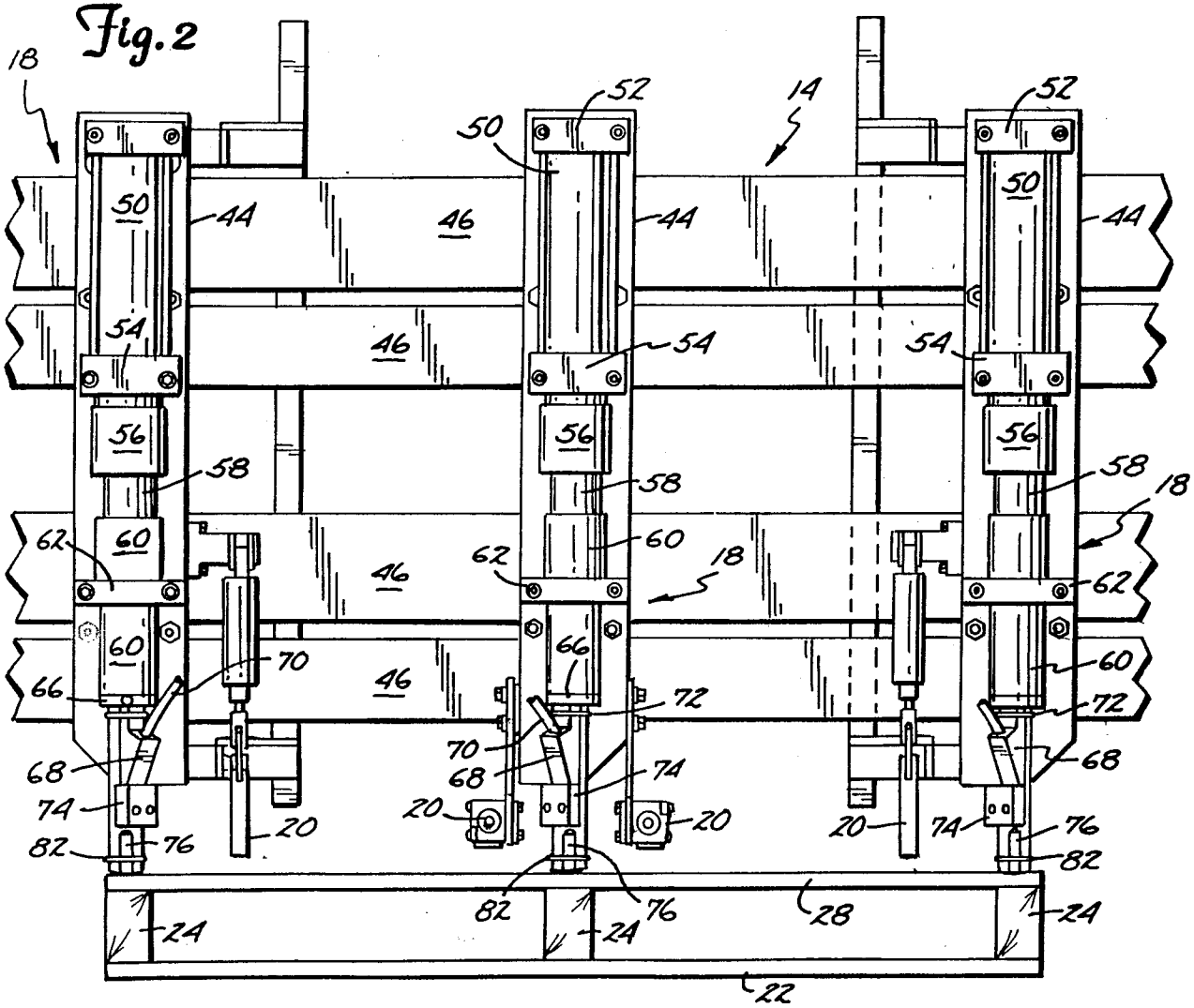
FIG. 2 is a rear view of a portion of the traveling bridge of the pallet-making machine of FIG. 1, showing nail-driving chucks of the present invention.

FIG. 2 shows a portion of traveling bridge 14 from the opposite side to that shown in FIG. 1. In FIG. 2, and in the side view shown in FIG. 3, chuck assemblies 18 can be seen more clearly. In the embodiment shown in FIGS. 1 and 2, three nail driving chuck assemblies 18 are mounted on traveling bridge 14. This corresponds to a pallet having three parallel stringers 24. In other embodiments, however, the number of chuck assemblies can vary. For example, another common type of wooden pallet uses four parallel stringers and in that case four chucks are required.

Each chuck assembly 18 has a chuck back plate 44 which is attached to cross bars 46 of traveling bridge 14 by clamps 48. By releasing clamps 48, chuck back plates 44 are permitted to slide along cross bars 46, which permits the position of each of the chuck assemblies 18 to be adjusted so that each chuck 18 is centered on the centerline of one of the stringers 24.

Mounted at the upper end of chuck back plate 44 is hydraulic cylinder 50. Brackets 52 and 54 mount hydraulic cylinder 50 to back plate 44. Coaxially attached to the lower end of hydraulic cylinder 50 is cylinder end cap 56.

Figure 4B:
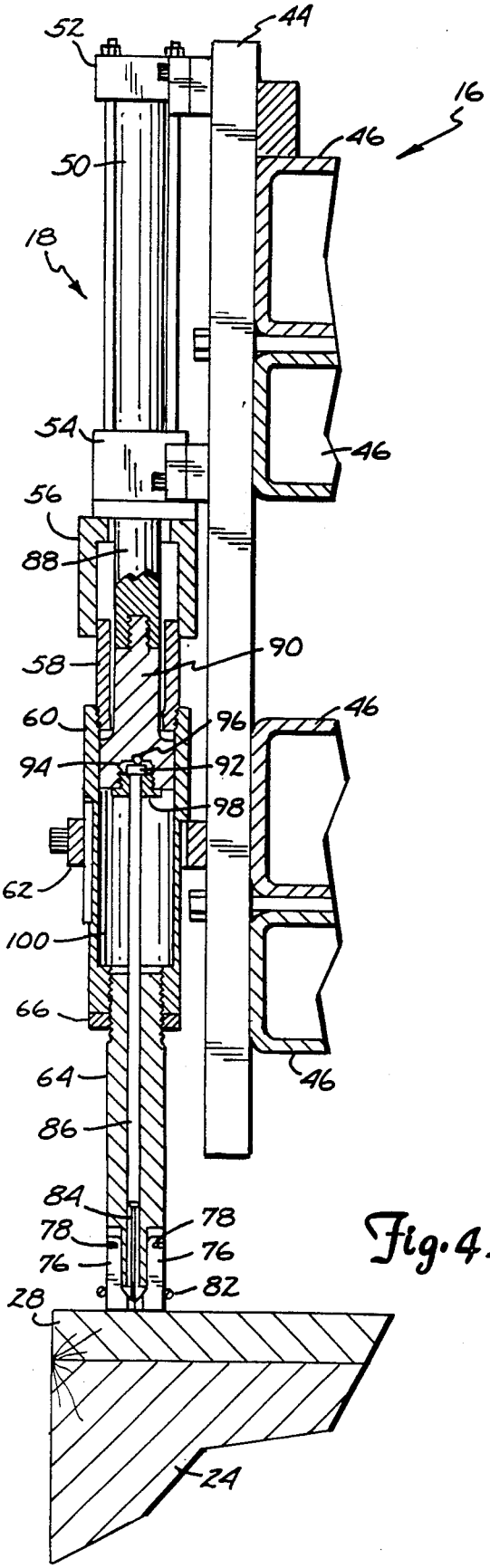

Coaxially aligned with cylinder end cap 56 is spring and pin retainer 58. As is shown further in FIGS. 4A–4C and as will be discussed later, spring and pin retainer 58 is mounted in a telescoping, axially movable relationship to cylinder end cap 56. FIG. 2 shows spring and pin retainer 58 in its downward extended position. The upward retracted position is shown in FIG. 4A.

Attached to the lower end of retainer 58 is chuck upper body 60. Retainer 58 and upper body 60 are movable axially together. Brace 62 provides a guide for movement of upper body 60 in the axial direction.

Extending out the lower end of upper body 60 is chuck lower body 64. Lock ring 66 connects together the lower end of upper body 60 and the upper end of lower body 64. Attached to one side of lower body 64 is nose 68, which is connected through tube 70 to the nail supply picker mechanism 42. Individual nails are supplied through tube 70 to nose 68 and thereby into lower body 64. Nose 70 is connected to lower body 64 by a roll pin (not shown) and is held in place by O-ring 72 and nose retainer 74.

Figure 4C:
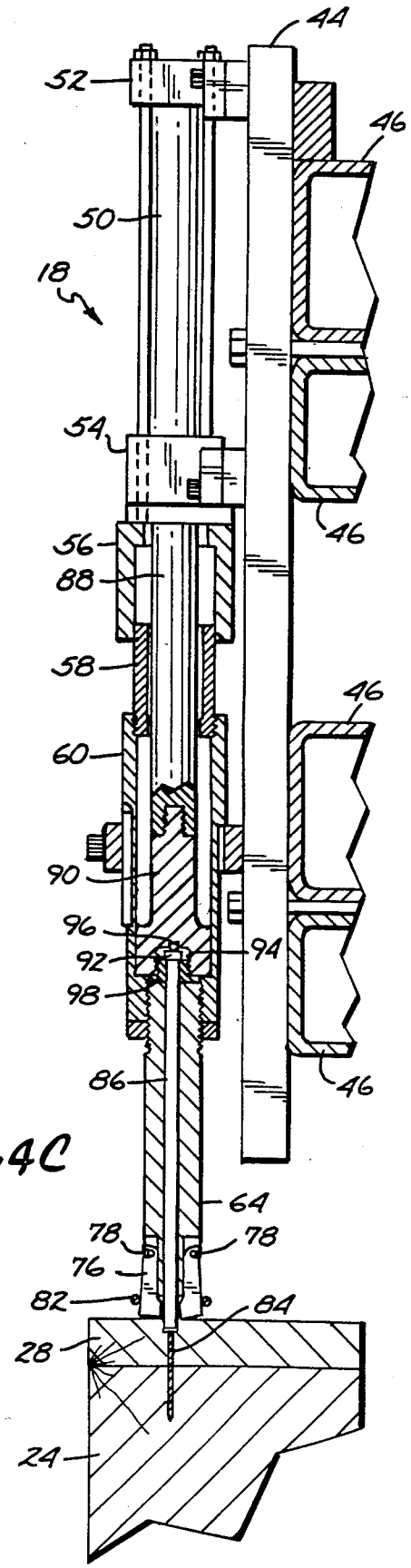

At the lower end of lower body 64 are a pair of pivotally mounted chuck jaws 76. As shown in FIGS. 4A–4C, 5 and 6, chuck jaws 76 are pivotally mounted on roll pins 78 and normally are positioned within recesses 80 located in the lower end of lower body 64. Jaws 76 have their lower ends biased together by resilient O-ring 82. This causes the jaws 76 to remain closed until a nail 84 (shown in FIGS. 4A–4C and 6) is driven out through jaws 76 by drive pin 86, as shown in FIG. 4C.

FIGS. 4A–4C illustrate the operation of chuck assembly 18 of the present invention. FIG. 4A illustrates chuck assembly 18 in its retracted or unenergized state. This is the state of chuck assembly 18 before it receives a command from the control system to drive a nail. As seen in FIG. 4A, the jaws 76 at the lower end of lower body 64 are spaced above the top surface of board 28.

FIG. 4B shows an intermediate position of chuck assembly 18. At this point in the operation, upper body 60 along with retainer 58 and lower body 64 has been driven down until jaws 76 have engaged the top surface of board 28.

FIG. 4C shows the final stage of the nailing operation in which drive pin 86 has driven nail 84 out through jaws 76 and into board 28. Notice that nail 84 has been countersunk into board 28.

As shown in FIGS. 4A–4C, hydraulic cylinder 50 has an axially movable drive rod 88. Attached to the lower end of drive rod 88 by a threaded connection (as shown in FIGS. 4B and 4C) is drive pin spacer or connector 90. The upper end of drive pin spacer 90 is of the same diameter as drive rod 88, and is positioned within retainer 58 in both FIG. 4A and FIG. 4B. The lower end of drive pin spacer 90 has an outer diameter which generally conforms to the inner diameter of upper body 60. There is sufficient friction or drag between drive pin spacer 90 and the inner walls of upper body 60 that upper body 60 tends to move up and down with drive pin spacer 90.

Drive pin 86 has a head 92 at its upper end which is positioned within recess 94 in the bottom end of drive pin spacer 90. Drive pin head 92 is held in position within recess 94 by ball 96 and drive pin retainer nut 98. Drive pin 86 extends downward through the inner cavity 100 in upper body 60 and through bore 102 in lower body 64.

As shown in FIG. 4A, the operation of chuck 18 begins with drive rod 88 in its fully retracted uppermost position. In this position, jaws 78 are spaced above the top surface of board 28. Retainer 58 is fully retracted within cylinder end cap 56; and drive pin spacer 90 is in its fully retracted uppermost position, as is drive pin 86. Upper body 60 and lower body 64 are in their fully retracted uppermost positions because they are connected to spring and pin retainer 58.

When sensors 20 (FIGS. 1 and 2) sense the presence of a board and the microprocessor control sends a signal to hydraulic cylinder 50, drive rod 88 begins to be driven downward by hydraulic cylinder 50. In the first portion of the cycle, retainer 58, upper body 60, and lower body 64 move along with drive rod 88, drive pin spacer 90, and drive pin 86. In other words, all of the parts move together until the lower ends of jaws 76 engage the top surface of board 28. This is shown in FIG. 4B. At that point, nail 86 is being held in position immediately above board 28 and is ready to be driven into board 28 and then into stringer 24.

As soon as the downward movement of lower body 64 is stopped by engagement of jaws 76 with board 28, the downward movement of the attached parts (upper body 60 and retainer 58) also stops. As drive rod 88 continues to travel downward, drive pin 86, drive pin spacer 90, and drive rod 88 all move together relative to the now fixed positions of retainer 58, upper body 60, and lower body 64. Drive rod 88 continues to move downward until the lower end of drive pin spacer 90 bottoms out against the bottom end of cavity 100 within upper body 60. The stroke of drive rod 88, drive pin spacer 90, and drive pin 86 relative to upper body 60 is selected so that nail 84 will be not only driven out through chuck jaws 76, but that the head of nail 84 will be countersunk a predetermined distance below the top surface of board 28. As shown in the Figures, the stroke can be adjusted by changing the relative distance from the lower end of upper body 60 to the lower end of lower body 64. This is possible because the two parts are connected together by threads and then locked in place with lock ring 66.

Once the bottom of the stroke has been reached, further application of hydraulic force will not cause any further downward movement. Instead, the build up of resistance to movement is sensed in the form of increased fluid pressure in hydraulic cylinder 50, and hydraulic cylinder 50 is operated in the opposite direction to retract drive rod 88 back to the position shown in FIG. 4A.

With the compensating nail chucks 18 in the present invention, wide variations in the thickness and hardness of boards 28 can be accommodated. Because the chuck assembly first seeks the top surface of board 28, then drives the nail by a predetermined distance set by the stroke of drive pin 86 relative to upper body 60, a uniform countersink distance is accomplished despite variations in thickness and board hardness.

Although the present invention has been described with reference to preferred embodiments, workers skilled in the art will recognize that changes may be made in form and detail without departing from the spirit and scope of the invention.

What is claimed is:

1. A nail-driving chuck for driving a nail into a board, the chuck comprising:

hydraulic drive means for driving a drive member in downward and upward directions along a generally vertical axis;

nail driving means connected to a lower end of the drive member and coaxially aligned with the drive member for driving the nail downwardly into the board;

a chuck body coaxially aligned with the drive member and the nail driving means, the chuck body having a cavity into which the drive member extends and a bore positioned below the cavity and through which the nail driving means extends;

jaw means positioned at a lower end of the chuck body for holding the nail;

means for permitting telescoping movement of the chuck body with respect to the hydraulic drive means;

wherein at a beginning of a nail driving cycle the drive member, the nail driving means and the chuck body are at upper end positions of their travel along the vertical axis;

wherein during a first portion of the cycle the drive member is driven downward and the nail driving means and the chuck body move downward with the drive member until a top surface of the board is engaged;

wherein during a second portion of the cycle the drive member and the nail driving means continue to move downward while the chuck body remains stationary to drive the nail out through the jaw means and into the board so that a top end of the nail is countersunk with respect to the top surface of the board, the drive member moving downward until stopped by engagement with a lower end of the cavity; and wherein during a third portion of the cycle the drive member and nail driving means move upward toward their upper end positions and wherein the drive member engages an upper end of the cavity to cause the chuck body to move with the drive member toward the upper end position of the chuck body.

2. The nail-driving chuck of claim 1 wherein the nail-driving means comprises:

a drive pin having a distal end for engaging a head of the nail and having a proximal end connected to the drive member.

3. The nail-driving chuck of claim 2 wherein the drive means includes a hydraulic cylinder, and the drive member includes a drive rod and a connector for connecting a distal end of the drive rod and the proximal end of the drive pin.

4. The nail-driving chuck of claim 3 wherein the connector engages a lower end of the cavity to limit downward travel of the drive rod and drive pin.

5. The nail-driving chuck of claim 1 wherein the means for permitting telescoping movement includes first and second coaxially aligned sleeves, the first sleeve connected to the drive means and the second sleeve connected to the chuck body.

6. The nail-driving chuck of claim 1 wherein the chuck body includes an upper body containing the cavity and a lower body containing the bore.

7. The nail-driving chuck of claim 6 wherein the upper body and lower body are adjustably connected together to permit adjustment of total length of the chuck body and thereby adjustment of depth of countersinking of the nail.

8. The nail-driving chuck of claim 1 and further including means for supplying nails one at a time to the lower body.

* * * * *